US010837722B2

(12) United States Patent
Boud

(10) Patent No.: US 10,837,722 B2
(45) Date of Patent: Nov. 17, 2020

(54) APPARATUS FOR STORING AND LOADING AMMUNITION

(71) Applicant: Eric Boud, Salt Lake City, UT (US)

(72) Inventor: Eric Boud, Salt Lake City, UT (US)

( * ) Notice: Subject to any disclaimer, the term of this patent is extended or adjusted under 35 U.S.C. 154(b) by 0 days.

(21) Appl. No.: 16/246,148

(22) Filed: Jan. 11, 2019

(65) Prior Publication Data

US 2020/0224986 A1 Jul. 16, 2020

(51) Int. Cl.
*F41A 9/83* (2006.01)
*F41A 9/65* (2006.01)

(52) U.S. Cl.
CPC .. *F41A 9/83* (2013.01); *F41A 9/65* (2013.01)

(58) Field of Classification Search
CPC ..... F41A 9/82; F41A 9/83; F41A 9/84; F41A 9/85; F42B 39/002; F42B 39/26
See application file for complete search history.

(56) References Cited

U.S. PATENT DOCUMENTS 863,798 A * 8/1907 Hodges ..... F41A 9/84 42/87
1,464,659 A * 8/1923 Keely ..... A45F 5/021 224/247
2,477,806 A * 8/1949 Isaacson ..... F41A 9/83 224/247
4,733,773 A * 3/1988 LaBianca ..... F42B 39/00 206/3
8,650,792 B1 * 2/2014 Overmars ..... F41A 9/83 42/87
8,931,633 B2 * 1/2015 Martin, III ..... F41A 9/85 206/3
9,212,859 B1 * 12/2015 Tal ..... F41A 9/83
9,835,396 B1 * 12/2017 Sherman ..... F41A 9/85
9,921,015 B1 * 3/2018 Roe ..... F41A 9/83
2008/0244952 A1 * 10/2008 Taylor ..... F41A 9/83 42/87
2014/0124387 A1 * 5/2014 Iannello ..... F42B 39/02 206/3

* cited by examiner

*Primary Examiner* — Gabriel J. Klein
(74) *Attorney, Agent, or Firm* — Strong & Hanni, P.C.; Joseph Shapiro

(57) ABSTRACT

A method and apparatus for storing and loading ammunition cartridges are disclosed. An ammunition apparatus may comprise a bay that is substantially cylindrically shaped, an access channel, a slide restraint, and a saddle. The access channel may be a cross sectional cutout in the bay. The slide restraint may comprise five fins shaped to track the contour of the tapered end of a cartridge. The saddle may be disposed on the outside of the bay, opposite the access channel, and may be shaped to complement the contour of a cartridge. An ammunition tray may comprise multiple ammunition apparatuses secured together. A user may load a cartridge from an ammunition tray into a magazine by using an ammunition apparatus saddle to partially displace an already loaded cartridge and then using his or her thumb to slide a cartridge from the ammunition tray into the magazine.

3 Claims, 20 Drawing Sheets

200

200

200

200

200

200

APPARATUS FOR STORING AND LOADING AMMUNITION

BACKGROUND OF THE INVENTION

Handguns are useful for recreational, protective, military, police, and other applications. Many handguns use a magazine loaded with cartridges. The mechanisms of the handgun load a cartridge into the barrel, from which the bullet is discharged out of the handgun barrel and muzzle.

Using such a handgun requires loading cartridges into the magazine, which is generally a spring-loaded system into which cartridges are loaded from the top, one by one. Loading cartridges into a magazine may require individually retrieving each cartridge from packaging or from another storage repository. When a magazine is large, or is repeatedly reloaded, or when multiple magazines must be loaded, handling the cartridges and loading them into a magazine may be time-consuming and inefficient. What is needed is a better method and apparatus for storing and/or loading cartridges into a magazine or other repository.

DETAILED DESCRIPTION OF THE INVENTION

Figure 1A:
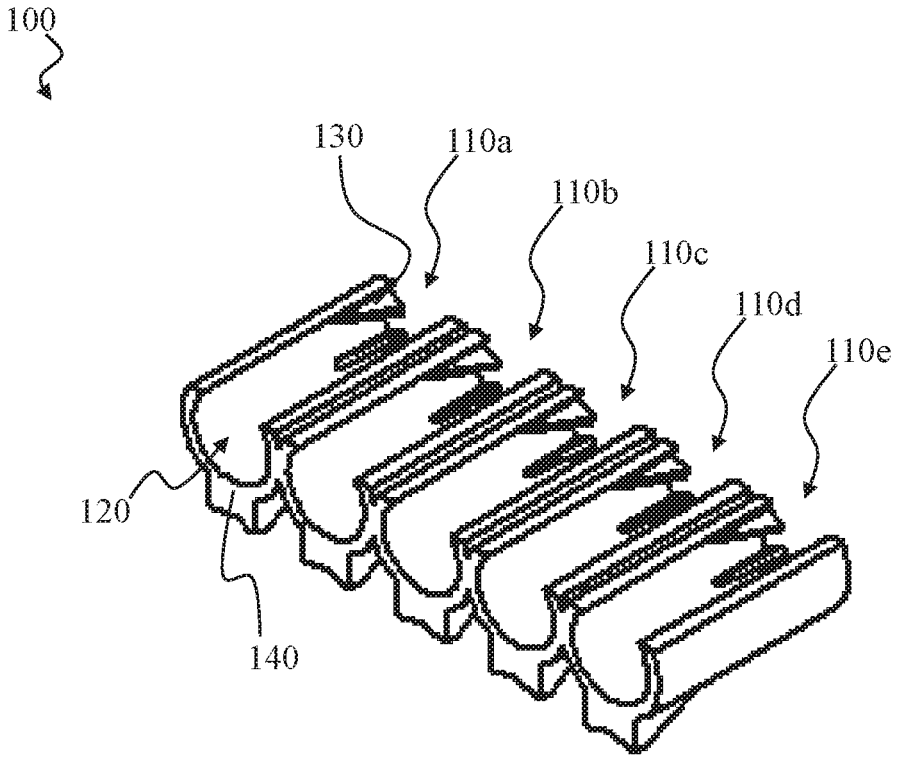
FIG. 1*a* shows a front elevated view of an exemplary ammunition tray.
Figure 1B:
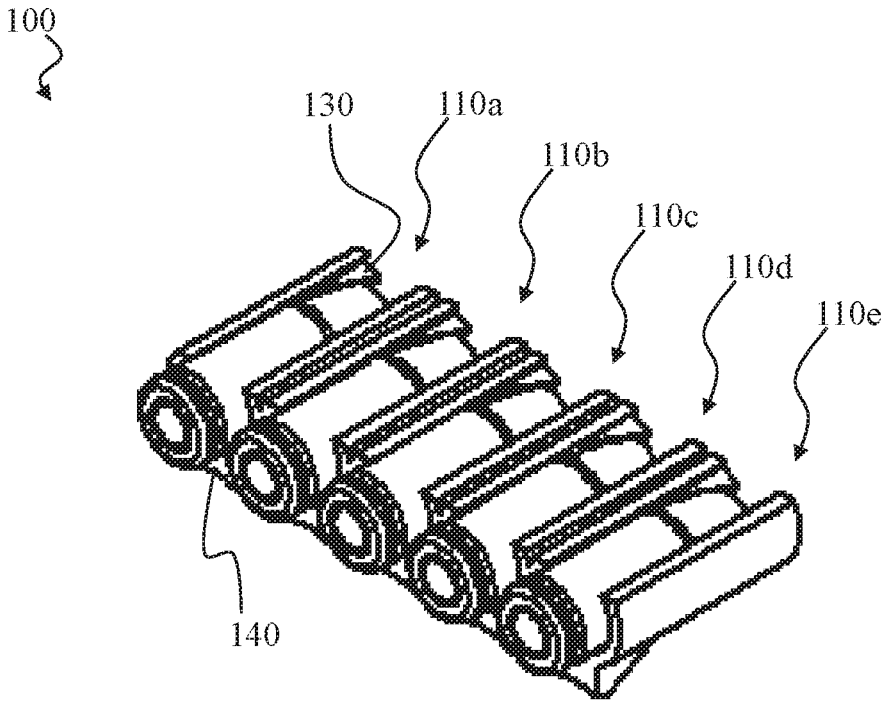
FIG. 1*b* shows a front elevated view of an exemplary ammunition tray populated with cartridges.
Figure 2A:
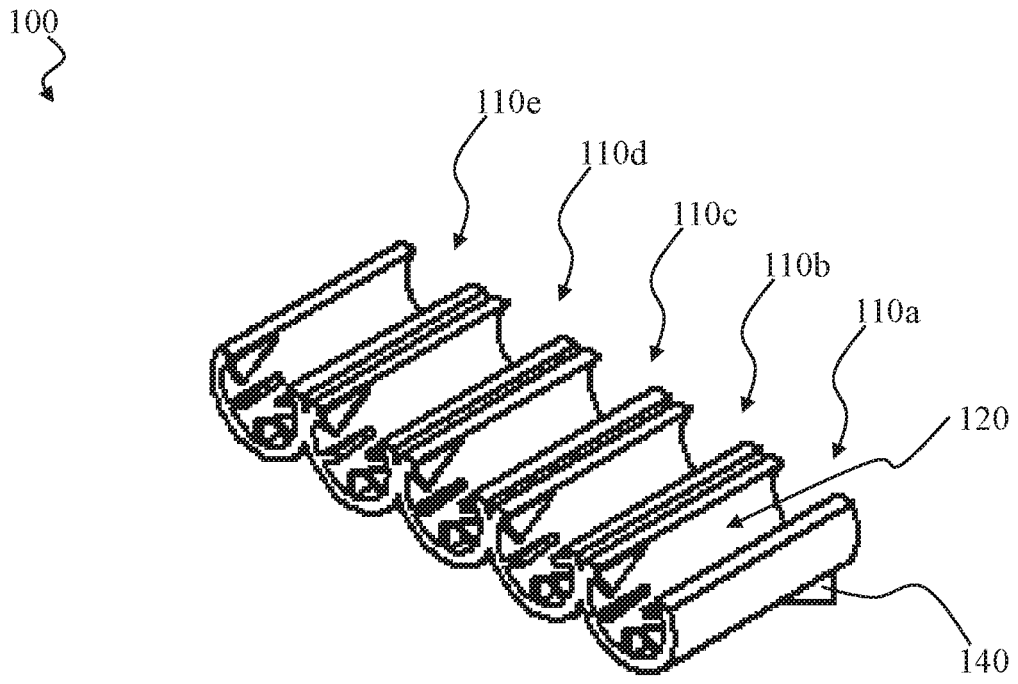
FIG. 2*a* shows a rear elevated view of an exemplary ammunition tray.
Figure 2B:
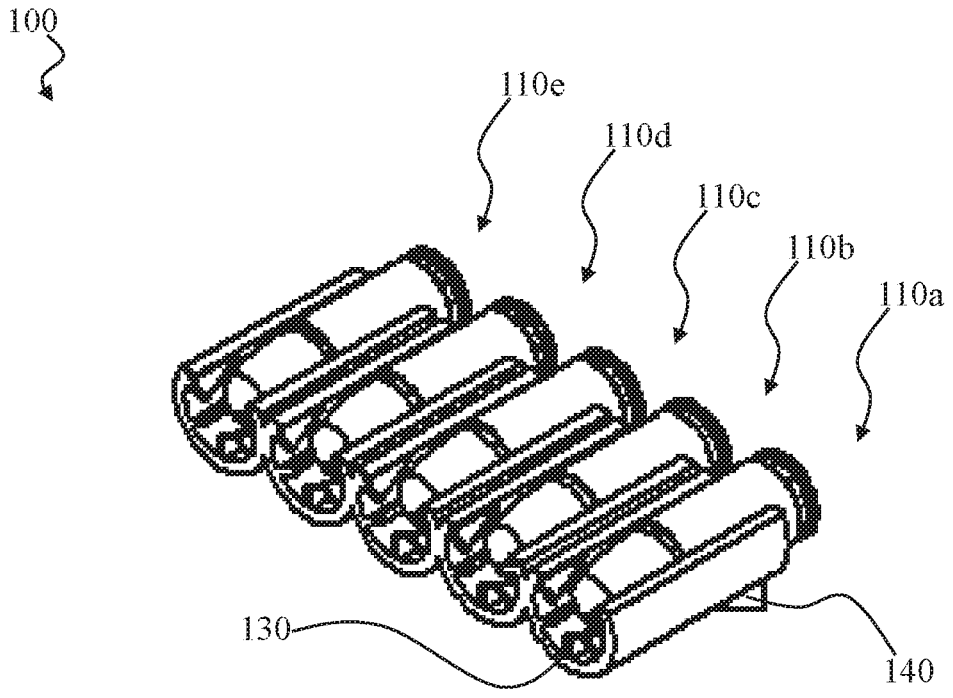
FIG. 2*b* shows a rear elevated view of an exemplary ammunition tray populated with cartridges.
Figure 3A:
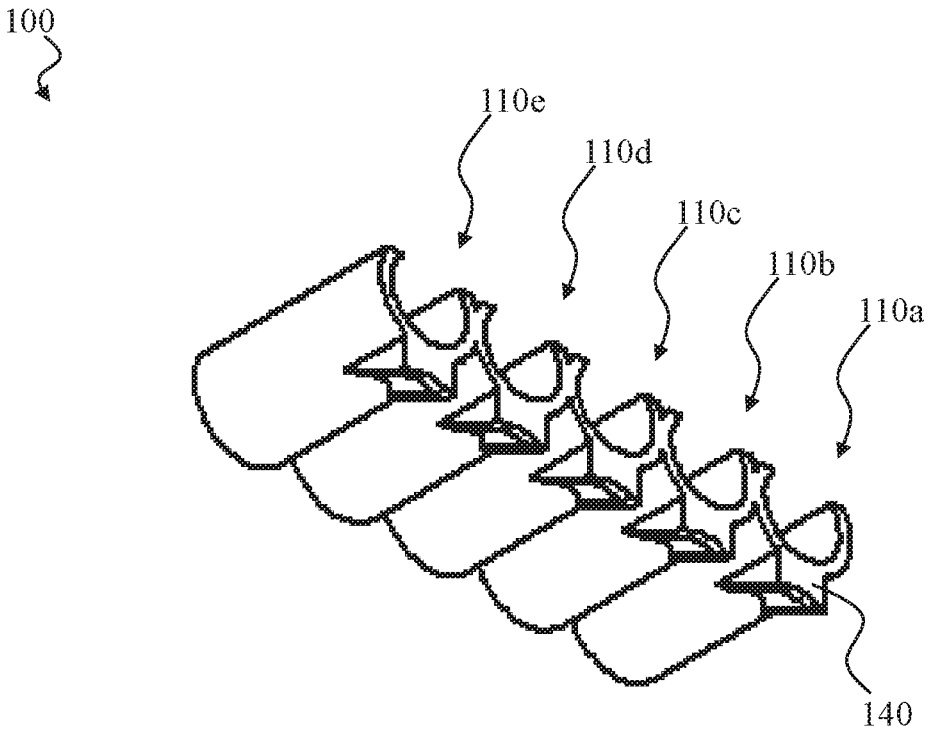
FIG. 3*a* shows a rear underside view of an exemplary ammunition tray.
Figure 3B:
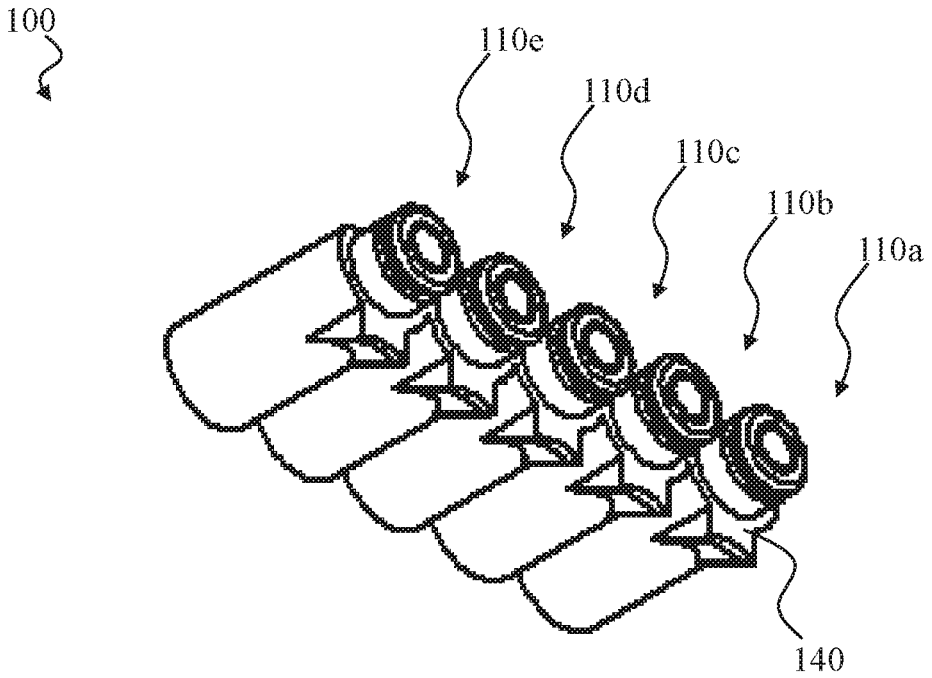
FIG. 3*b* shows a rear underside view of an exemplary ammunition tray populated with cartridges.
Figure 4A:
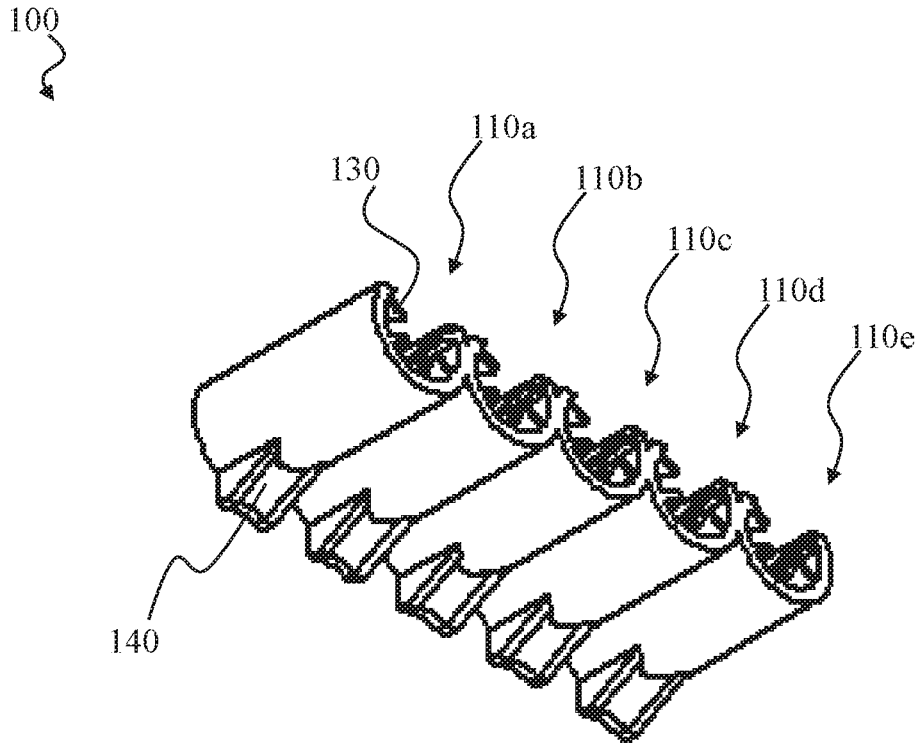
FIG. 4*a* shows a front underside view of an exemplary ammunition tray.
Figure 4B:
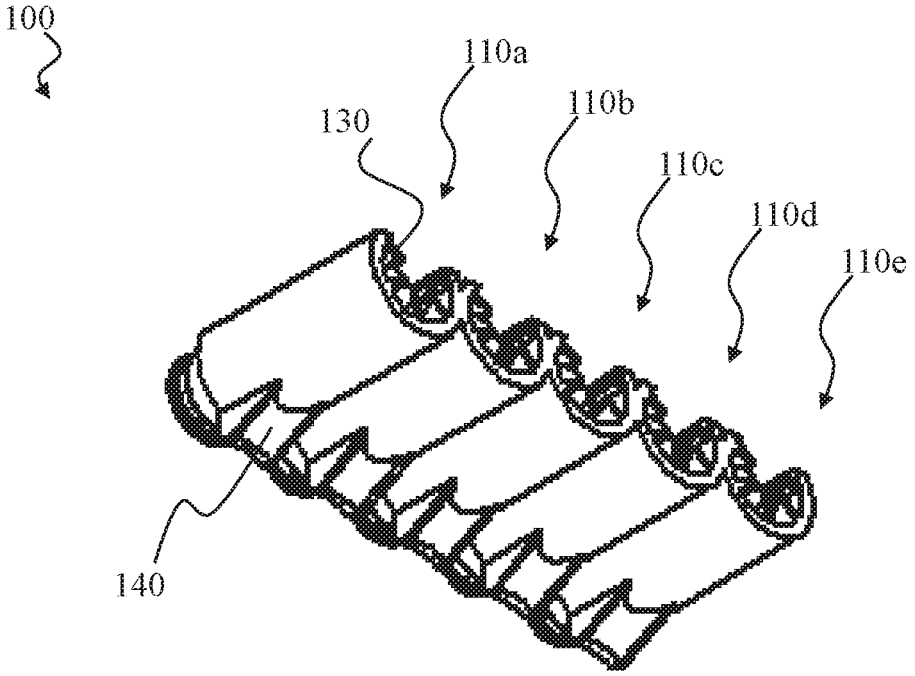
FIG. 4*b* shows a front underside view of an exemplary ammunition tray populated with cartridges.
Figure 5A:
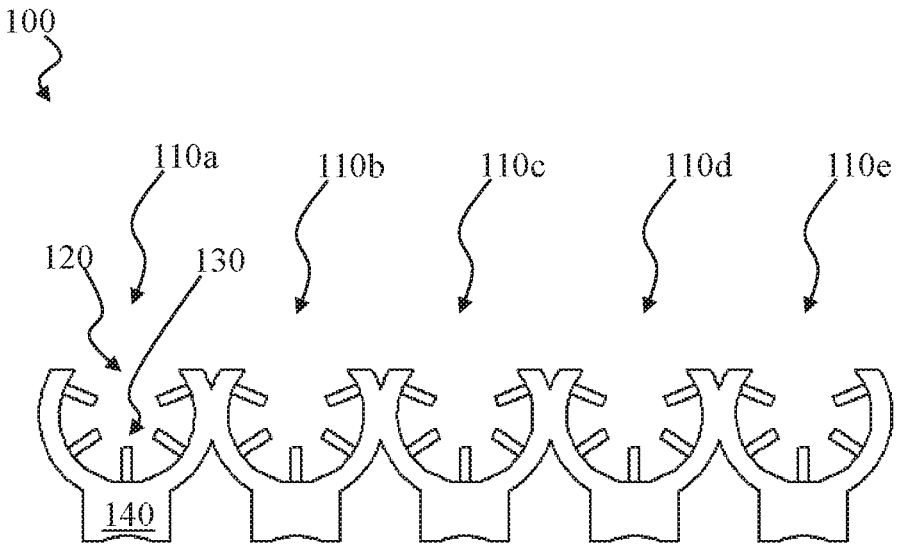
FIG. 5*a* shows a front level view of an exemplary ammunition tray.
Figure 5B:
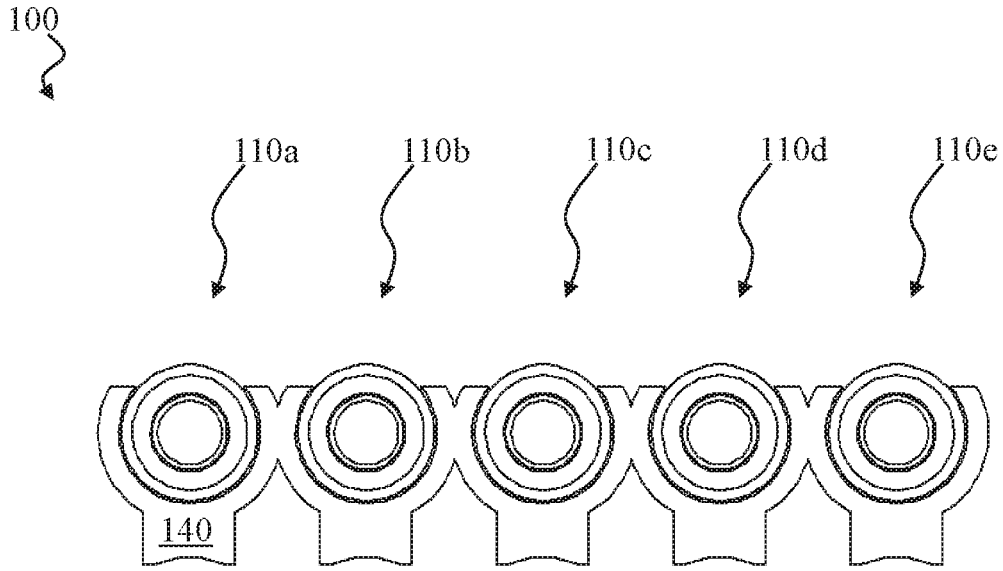
FIG. 5*b* shows a front level view of an exemplary ammunition tray populated with cartridges.

A system and method are disclosed for storing cartridges and loading cartridges into a magazine or other repository.

Table of Reference Numbers from Drawings:

The following table is for convenience only and should not be construed to supersede any potentially inconsistent disclosure herein.

| Reference Number | Description |
|---|---|
| 100 | one-dimensional ammunition tray |
| 110a | bay of ammunition tray |
| 110b | bay of ammunition tray |
| 110c | bay of ammunition tray |
| 110d | bay of ammunition tray |
| 110e | bay of ammunition tray |
| 120 | access channel |
| 130 | slide restraint |
| 140 | saddle |
| 150 | thumb |
| 200 | two-dimensional ammunition tray |
| 300 | flowchart |
| 310 | step in exemplary method for loading a gun |
| 320 | step in exemplary method for loading a gun |
| 330 | step in exemplary method for loading a gun |
| 340 | step in exemplary method for loading a gun |
| 350 | step in exemplary method for loading a gun |
| 360 | step in exemplary method for loading a gun |
| 370 | step in exemplary method for loading a gun |
| 400 | gun magazine |
| 500 | ammunition tray with built-in loading tool |
| 510 | loading tool |
| 512 | saddle |
| 514 | finger adapter |

FIGS. 1-10*b* show an exemplary cartridge storage apparatus, which may be alternatively referred to as an ammunition tray.

An ammunition tray may comprise a tray configured to store, and facilitate loading of, a one-dimensional array of cartridges. Although a preferred embodiment is a one-dimensional array, some embodiments may comprise a two-dimensional array or three-dimensional array for storing and/or loading cartridges.

As shown in FIGS. 1-6, an exemplary ammunition tray 100 may comprise a monolithic row of bays 110*a-e*, each similarly shaped and contoured to store a cartridge and facilitate loading the cartridge into a magazine. As discussed herein below, bay 110*a* is representative of the other bays 110*b-e* in an exemplary array of bays.

Bay 110*a* may be cylindrically shaped, or otherwise shaped depending on the shape of a particular style of cartridge. The size and scale of bay 110*a* may further be varied to accommodate cartridges of varying sizes and shapes. In some embodiments, bay 110*a* may be configured to hold cartridges of different shapes and sizes, e.g., by using graduated ribbing and other approaches known in the art for making devices that are universal or partially universal.

As shown in FIGS. 1-6, in an exemplary embodiment, bays 110*a-e* may be oriented so that the cartridges in the bay all point the same direction, and the long sides of the bays and associated cartridges are adjacent to each other.

In an alternative embodiment, one bay may be configured to hold multiple cartridges, i.e., without any material or walls separating cartridges.

In general, bays 110*a-e* in a one-dimensional array of bays 100 may comprise a monolithic apparatus. In some embodiments, however, the bays in a one-dimensional array may be configured to be secured to each other, e.g., through a tongue-and-groove system or through other systems known in the art for securing items to each other. Additionally, arrays of bays may be configured to be secured to each other, e.g., through a tongue-and-groove system or through other systems known in the art for securing items to each other.

As shown in FIGS. 1-6, bay 110*a* may be generally cylindrically shaped, wherein a portion of the cylinder, running along some or all of the length of the cylinder, is absent to allow a thumb, or finger, or other device to access and manipulate a cartridge in the cylinder as described herein below. This absent portion may be referred to as an access channel 120. In one embodiment, in which bay 110*a* is generally cylindrically shaped, access channel 120 may comprise a 60-degree cutout sector relative to a circular cross section of the cylinder. The size, shape, or other characteristics of the access channel may be modified or adapted depending on many factors, e.g., the size of the implement (e.g., thumb, other finger, or tool) that will be used to manipulate the cartridge, the strength or other properties of the bay material and the effect on structural integrity or other characteristics from removing an access channel, and slipperiness or friction characteristics of the cartridge.

In other embodiments, a bay may comprise an alternative manipulation access, e.g., a hole in one end through which an implement, finger, or other tool may access the cartridge to manipulate or apply force to the cartridge.

Figure 6A:
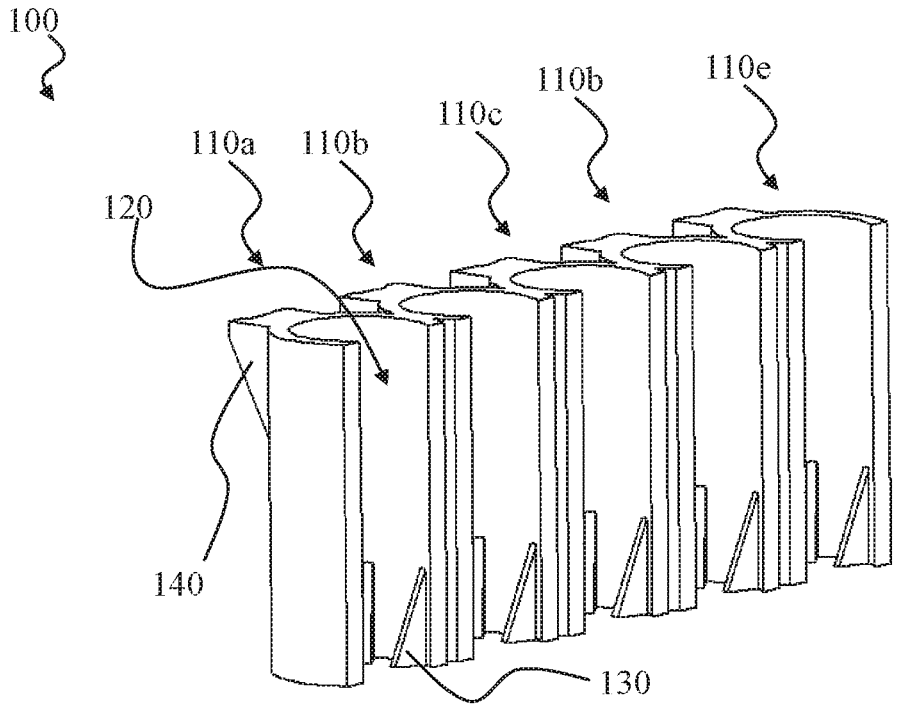
FIG. 6*a* shows a side, slightly elevated view of an exemplary ammunition standing on end.
Figure 6B:
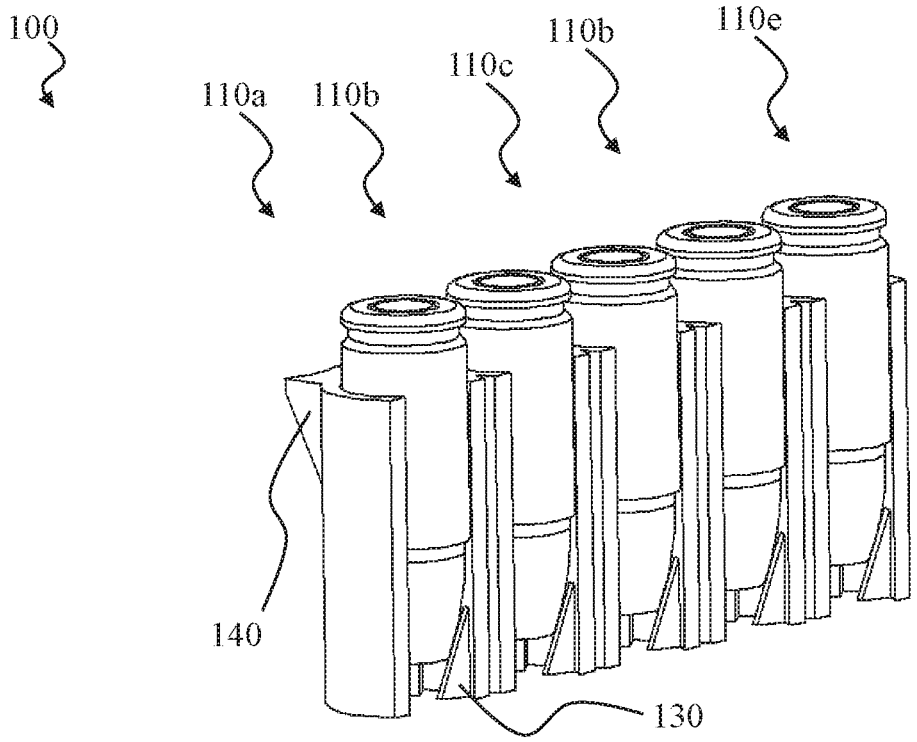
FIG. 6*b* shows a side, slightly elevated view of an exemplary ammunition standing on end, populated with cartridges.
Figure 7A:
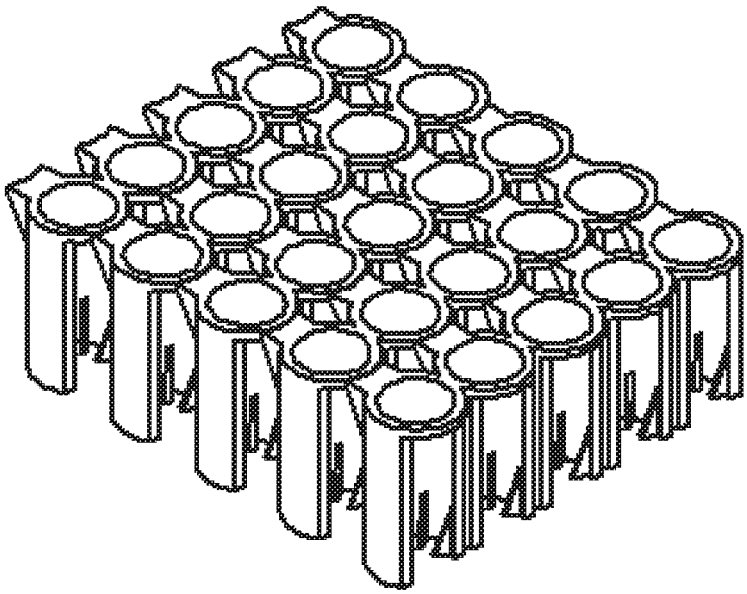
FIG. 7*a* shows an elevated angle view of an exemplary two-dimensional ammunition tray.
Figure 7B:
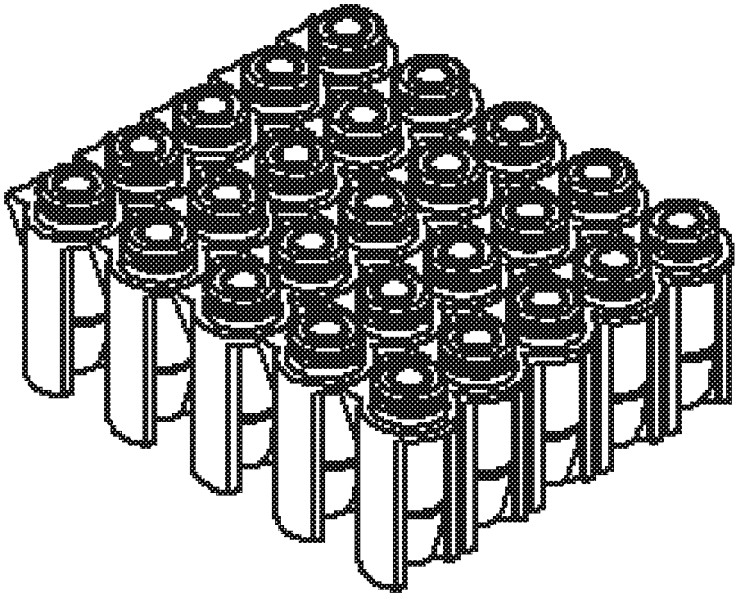
FIG. 7*b* shows an elevated angle view of an exemplary two-dimensional ammunition tray populated with cartridges.
Figure 8A:
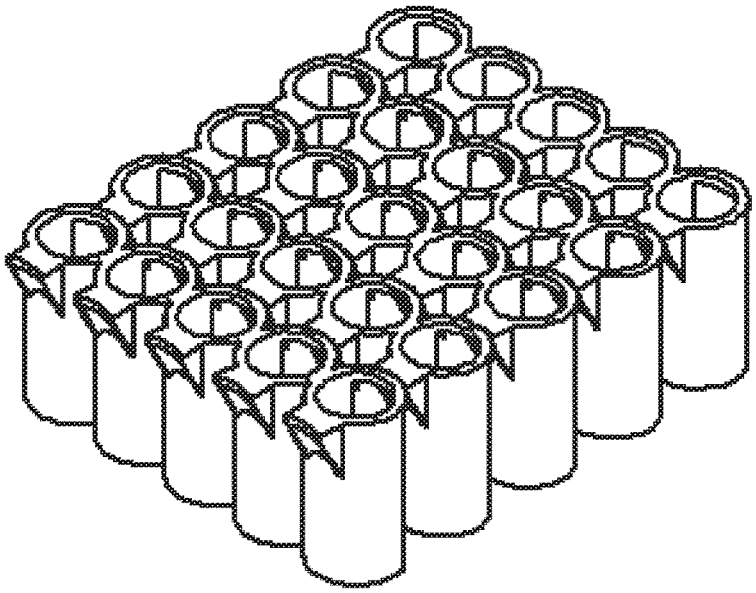
FIG. 8*a* shows an elevated angle view of an exemplary two-dimensional ammunition tray.
Figure 8B:
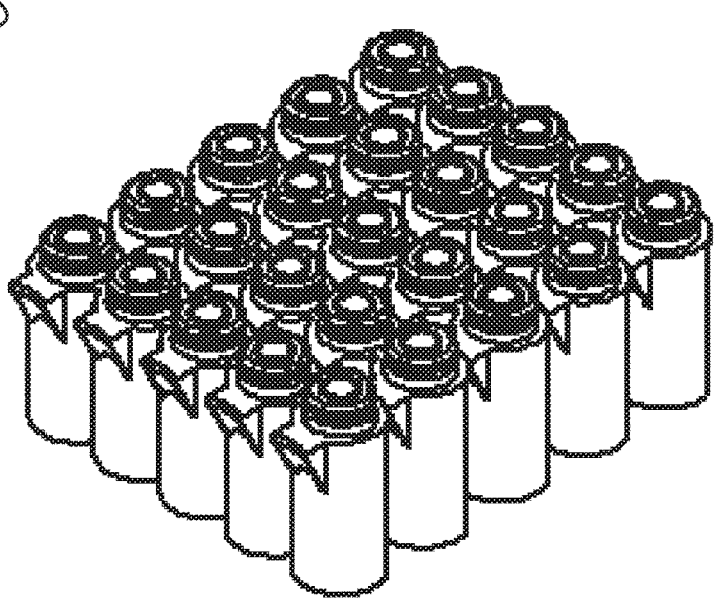
FIG. 8*b* shows an elevated angle view of an exemplary two-dimensional ammunition tray populated with cartridges.
Figure 9A:
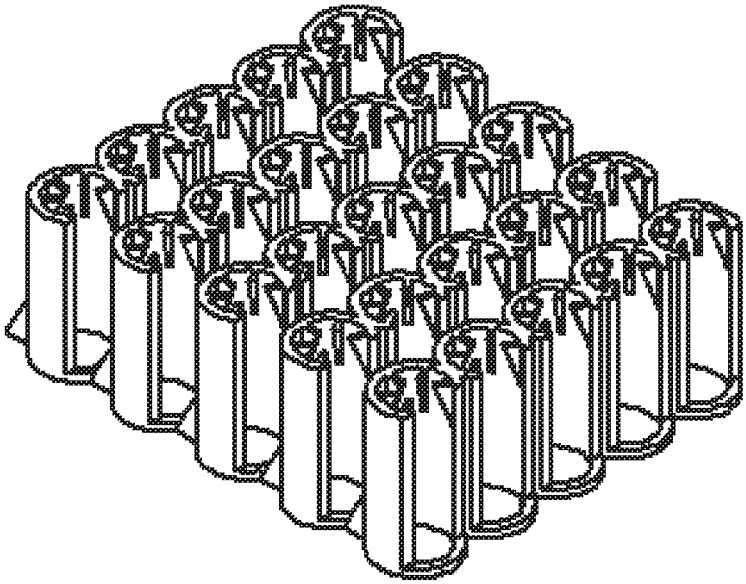
FIG. 9*a* shows an elevated angle view of an exemplary two-dimensional ammunition tray.
Figure 9B:
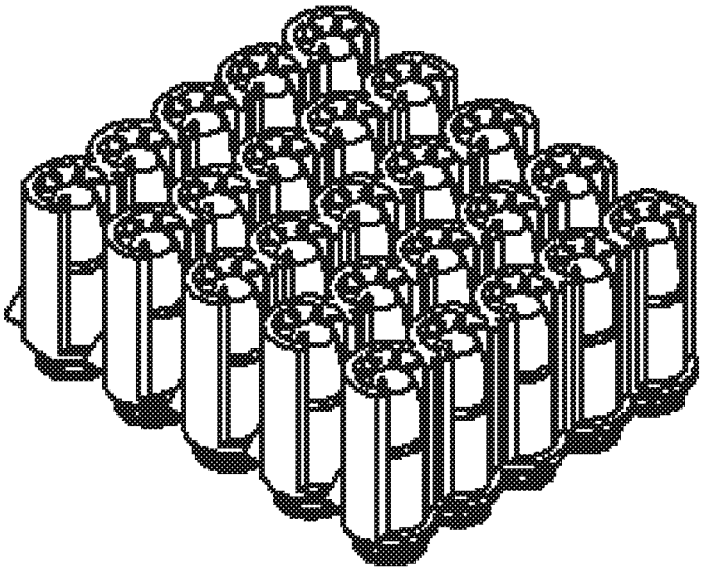
FIG. 9*b* shows an elevated angle view of an exemplary two-dimensional ammunition tray populated with cartridges.
Figure 10A:
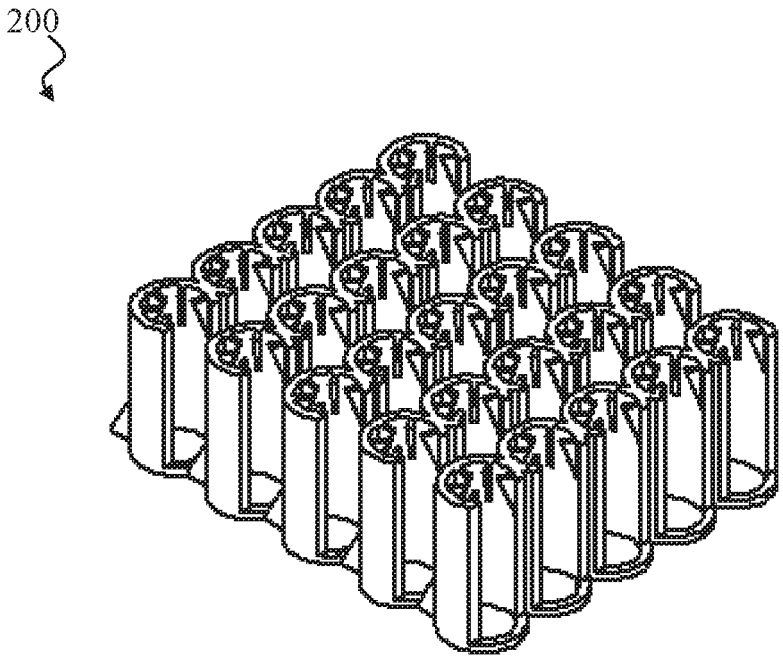
FIG. 10*a* shows an elevated angle view of an exemplary two-dimensional ammunition tray.
Figure 10B:
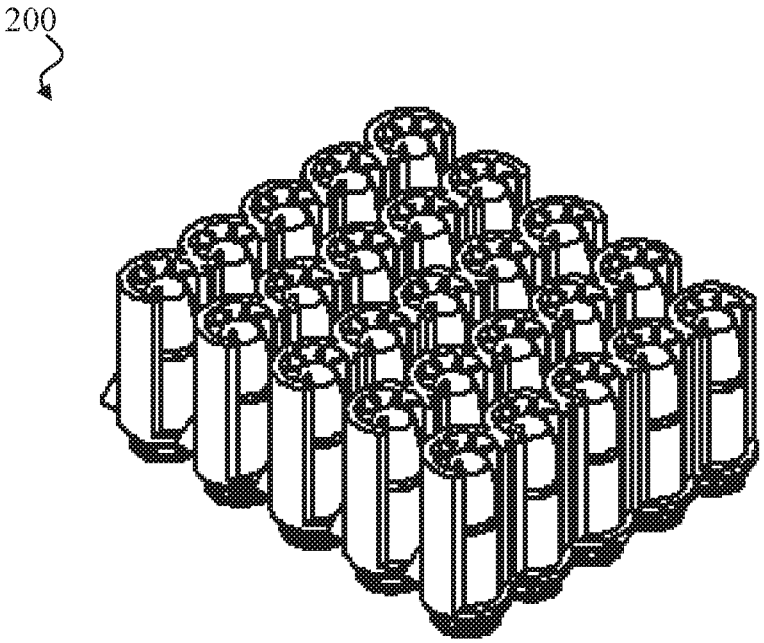
FIG. 10*b* shows an elevated angle view of an exemplary two-dimensional ammunition tray populated with cartridges.
Figure 11:
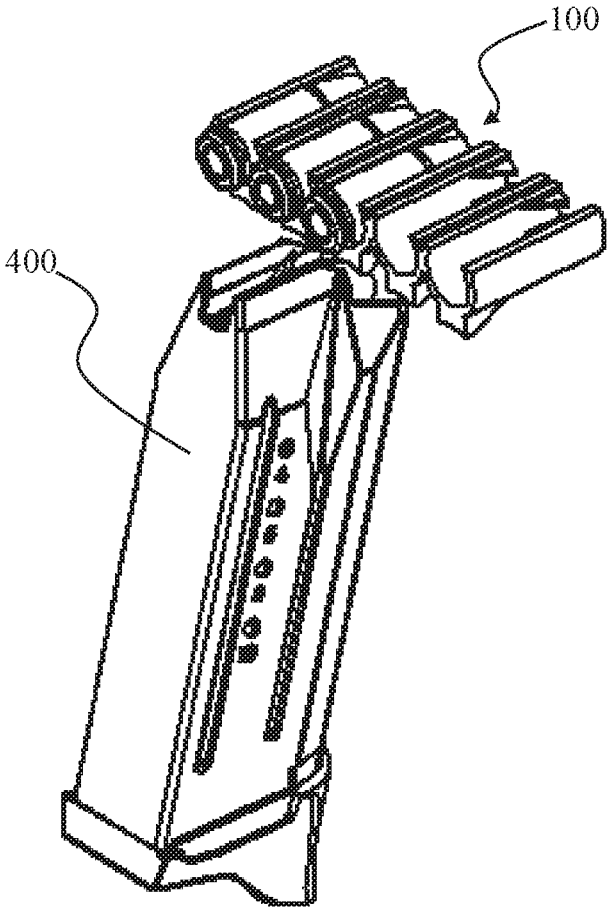
FIG. 11 shows an exemplary ammunition tray positioned for loading a cartridge into a magazine.

As shown in FIGS. 1-6, bay 110*a* may comprise a slide restraint 130 to prevent a cartridge from sliding downward, due to gravity or any other forces, when oriented such that a cartridge is pointed downward as shown in FIGS. 6*a* and 6*b*. In one embodiment, slide restraint 130 may be one or more fins as shown in FIGS. 1-2, 4, 5*a*, and 6. Other embodiments may employ one or more other extrusions or features, e.g., one or more bumps, to keep the cartridge from sliding. In an alternative embodiment, a bay may also comprise a slide restraint to prevent the cartridge from sliding in the other direction. Such a slide restraint may comprise fins, or a bump, and may also be sized or configured to allow sliding or passage when pressure is applied, but not when no pressure is applied. Such a pressure-sensitive slide restraint may comprise a small bump or other approaches as known in the art.

As shown in FIGS. 1-2, 4, and 6, fins comprising slide restraint 130 may be shaped to track the contours of a cartridge, e.g., tapered so that the bottom (as shown oriented in FIGS. 1-2, 4, and 6) of each fin is longer, e.g., protrudes further from the sidewall of bay 110*a*, to track the pointed shape of the cartridge.

Different fin shapes and designs may be used depending on the shape and/or contour of a particular cartridge.

Different numbers of fins may also be used. For example, one fin may be sufficient, although increasing the number of fins may result in increased stability, balance, and amenability to manipulation (e.g., sliding out of the bay), as described herein below. In an exemplary embodiment, as shown in FIGS. 1-2, 4, and 5-6, five fins may be used, and such fins may be equally spaced from each other.

Slide restraint 130 may be something other than fins. For example, slide restraint 130 may be may be solid and may be shaped such that it is complementary to the shape of the tip of a cartridge. In another embodiment, the slide restraint may comprise cross structural elements that provide a resting/stabilization point for the tip of the cartridge. A person of ordinary skill will appreciate that the slide restraint could be implemented in many ways, all of which are within the spirit of the disclosure here. The salient feature of the slide restraint is that it prevents the cartridge from exiting the bay in the direction of slide restraint 130. Additionally, the slide restraint may stabilize the cartridge, minimize shaking, wiggling, or other movement of the cartridge in the bay, and/or prevent the cartridge from exiting the cartridge through the access channel.

Figure 12:
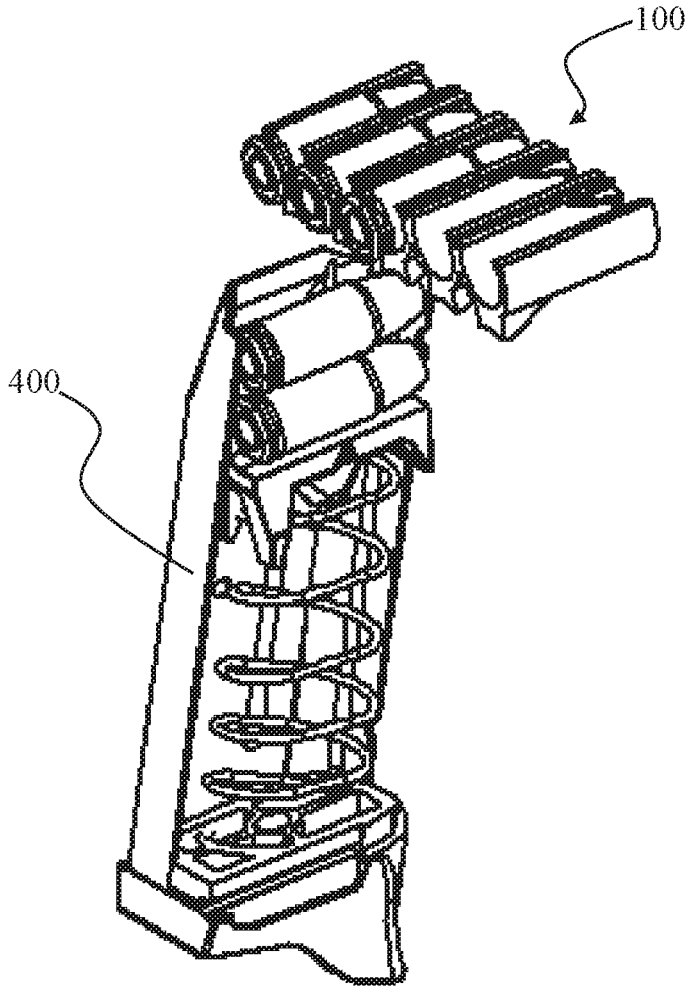
FIG. 12 shows an exemplary ammunition tray positioned for loading a cartridge into a magazine.

As shown in FIGS. 1-6, bay 110*a* may comprise an installation stabilization saddle 140, which may be referred to more succinctly as a "saddle." Saddle 140 may be shaped and contoured to track and complement the tapered (front) end of a cartridge, and to rest on the front end of a cartridge during cartridge loading, as shown in FIG. 12. In other embodiments, the saddle may be shaped to provide at least contact points for stabilization, e.g., a "V" shape. In one embodiment, and as shown in FIGS. 1-6, the saddle may comprise a curved end and a curved bed. A person of ordinary skill will appreciate that many variations on the saddle structures explicitly shown or described herein may be used for a saddle. For example, instead of a solid saddle, the saddle may comprise rails or a skeleton. The saddle could also be designed to track a greater or smaller portion of a loaded cartridge. In general, a smaller saddle is beneficial because it increases packing density of cartridges as described herein below. A large saddle may be beneficial because it may make it easier or more stable to rest and/or stabilize a bay on an already-loaded cartridge.

As shown in FIGS. 1-6, multiple bays 110*a*-110*e* may be secured to form an array 100 of bays. In one embodiment, an array of bays may be a monolithic unit, e.g., formed from an injection mold for the entire array, or comprising bays secured to each other by welding, glue, mechanical attachment items such as nails or screws, or otherwise secured.

Figure 14:
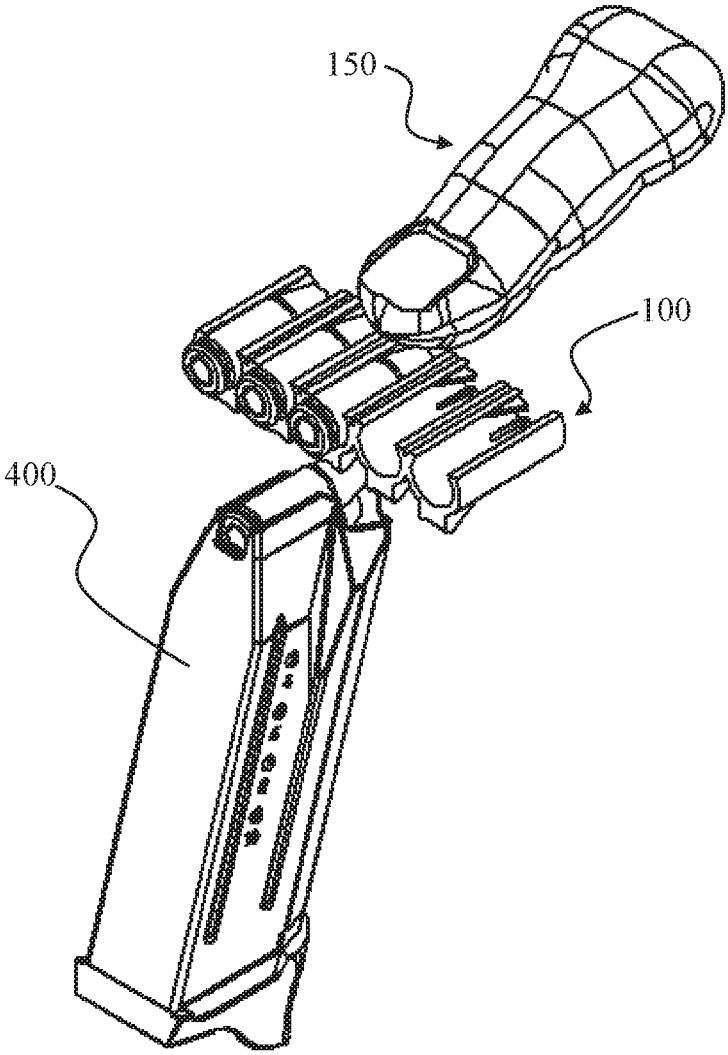
FIG. 14 shows a step for using a finger to load a cartridge from an exemplary ammunition tray into a magazine.
Figure 15:
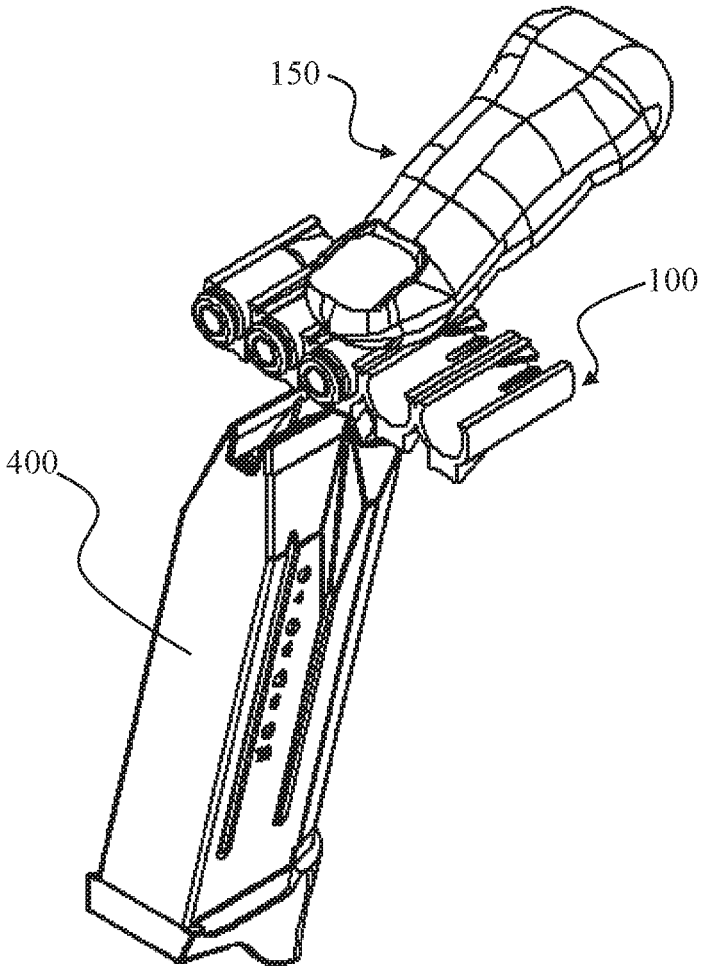
FIG. 15 shows a step for using a finger to load a cartridge from an exemplary ammunition tray into a magazine.
Figure 16:
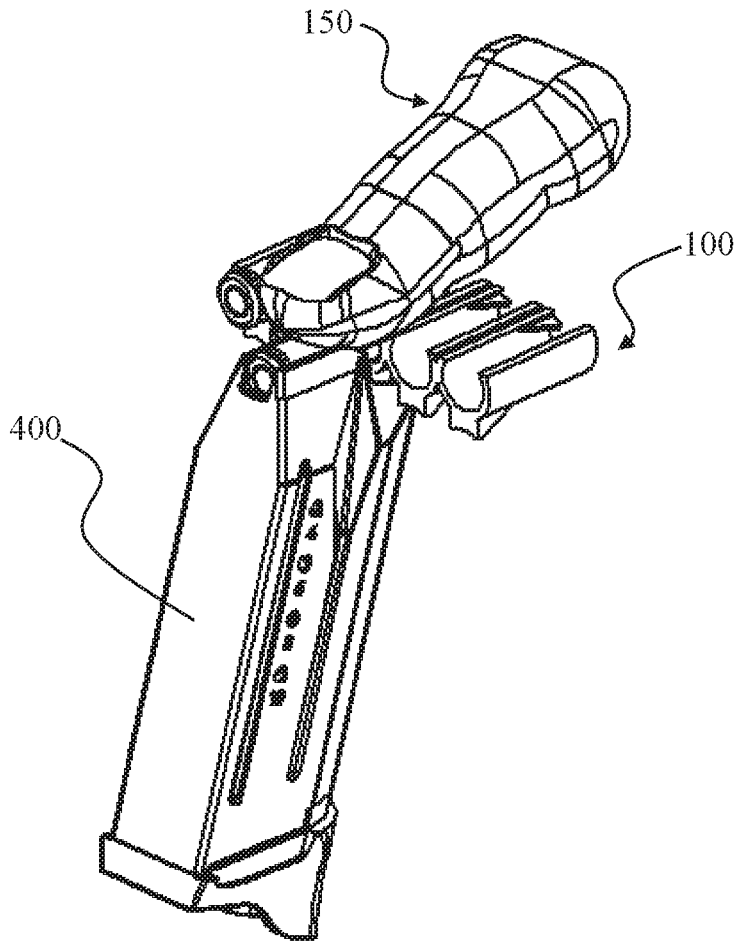
FIG. 16 shows a step for using a finger to load a cartridge from an exemplary ammunition tray into a magazine.

In general, an array 100 of bays may be of any size. For practical reasons, it may be beneficial for an array 100 of bays to comprise at least five bays. A minimum size of five may make it easier for a user to hold, secure, and manipulate the array of bays. FIGS. 14-16 show an example of how a user may use a finger to manipulate an array of bays, which r ray be referred to as a bay manifold. A thumb 150 is shown in FIGS. 14-16. Although not shown in FIGS. 14-16, a user may some or all of his remaining fingers on the same hand as thumb 150 to support ammunition tray 100 from the bottom (or from another side or direction as may be comfortable, convenient, or necessary) while the user uses his or her thumb 150 to manipulate a cartridge as shown in FIGS. 14-16.

The size of an array of bays may depend on cartridge size, loading application, storage and/or packing characteristics or limitations, user hand size or characteristics, magazine size, or other features or characteristics of a particular application.

As shown in FIGS. 7-10, arrays of bays may be combined for packing purposes, e.g., to fit inside a box. The curved end of saddle 140 may lend itself to stabilization and alignment when in a packed formation. A person of ordinary skill in the art will appreciate that the size, shape, contours, packing density, and other features of bays, arrays of bays, and packed arrays of bays A bay, or parts of a bay, or an array of bays make be made out of many materials or combinations of materials, e.g., plastic (e.g., polyethelene or ABS), metal, wood, recycled materials, biodegradable materials, and/or any other materials known in the art.

In one embodiment, an exemplary bay may be configured and/or shaped to generally track the sizing, shape, and contours of the cartridge. The bay may be made out of plastic, and the walls of the bay may be 0.05 inches thick. The thickness may vary for different parts of the bay. The access channel may be a 60-degree cutout. The slide restraint may have five fins, which may be 0.025 inches thick. These sizes, measurements, thicknesses, and other dimensions may vary based on materials and other characteristics of a particular application.

In some embodiments, an array of bay manifolds may be detachably connected, e.g., with thin plastic tabs to enable breaking and separating the manifolds from each other when pressure is applied.

In another embodiment, a bay may be loaded using a tool. For example, if the access channel is a hole in an end of a bay, then an assist tool may comprise a thin poker tool for going through the hole to apply pressure to the cartridge.

Figure 13:
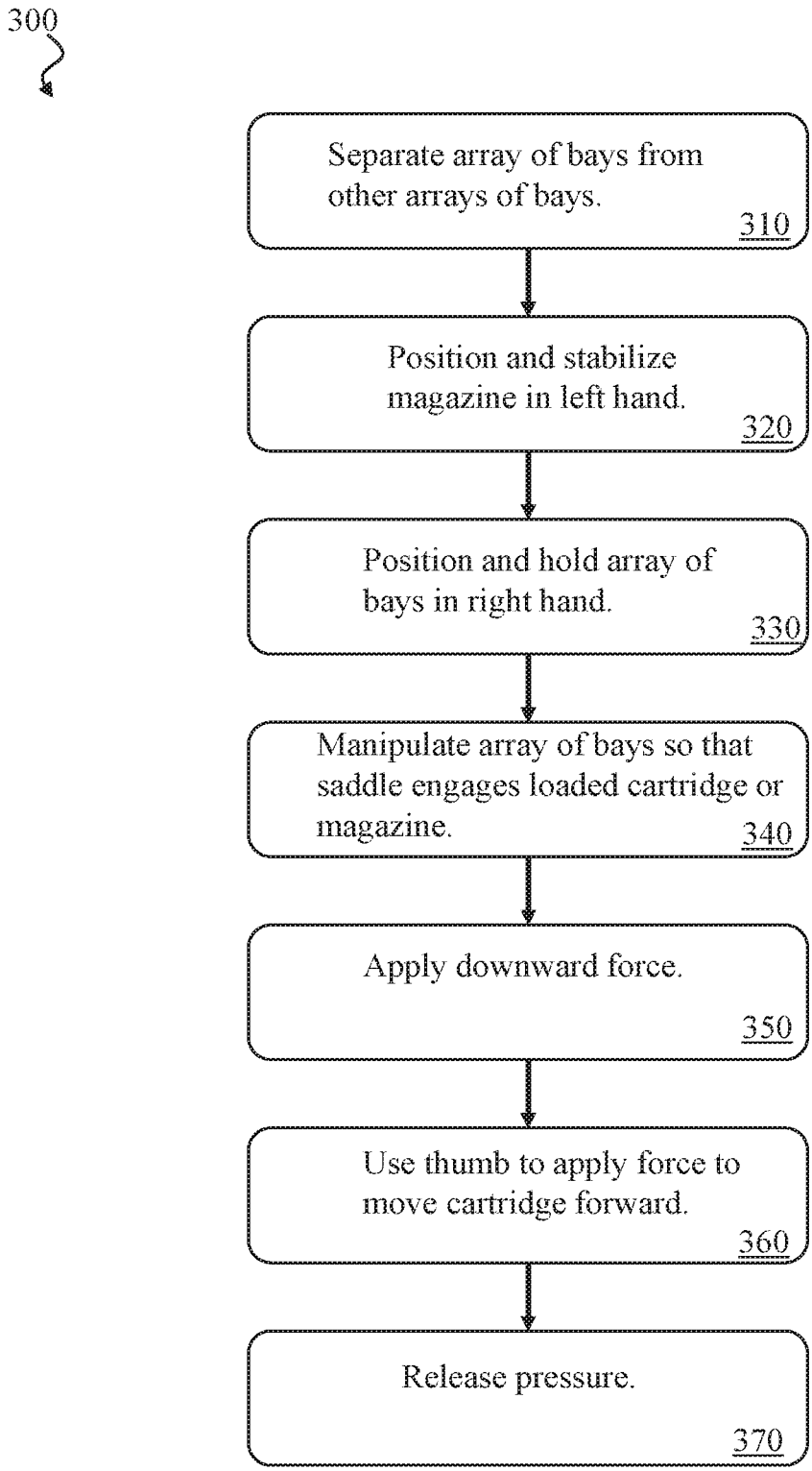
FIG. 13 shows a flowchart for an exemplary process for using an exemplary ammunition tray to load a cartridge into a magazine.

FIG. 13 shows a flowchart 300 for an exemplary method for loading a gun using the bays and arrays of bays as described herein.

At step 310, an array of bays may be separated from other arrays of bays in a packed formation.

At step 320, a user may position and stabilize a magazine in a left hand.

At step 330, a user may position hold and position the array of bays in a right hand, such that the rear of a first cartridge is positioned just above and in front of the cartridge entry of the magazine. A user may load cartridges from the array of bays in any order, although it may be easier to move from right to left when using a right hand, and from left to right when using a left hand. Attempting to load a cartridge straddled on both sides by other cartridges in an array of cartridges may result in a neighboring cartridge obstructing a thumb, finger, or other manipulating implement. Again, the order in which cartridges may be loaded from an array of bays may be based on the hand being used (right or left), the finger being used, the implement being used, characteristics of the magazine into which cartridges are being loaded, user preference or whim, or any other characteristics of a particular application or situation.

At step 340, and as shown in FIG. 14, a user may manipulate the array of bays such that the saddle of a first bay is directly above the tip of an already-loaded cartridge, and such the saddle engages the already-loaded cartridge by touching it from above.

At step 350, and as shown in FIG. 15, the user manipulates the array of bays to apply a downward force on the already-installed cartridge, thereby pushing the already-removed cartridge downward and displacing it sufficiently to allow for loading of the cartridge in the first bay of the array of bays.

At step 360, and as shown in FIG. 16, a user may apply pressure with a right thumb to the top of cartridge, and may thereby push the cartridge forward, out of the bay, toward and into entry of the magazine.

At step 370, a user may release pressure on the cartridge that has been slid out of the first bay, thereby allowing the resistance mechanism in the magazine, e.g., a spring, move upward, thereby securing the cartridge in a loaded position in the magazine.

The foregoing steps may be repeated for each cartridge to be loaded.

Figure 17A:
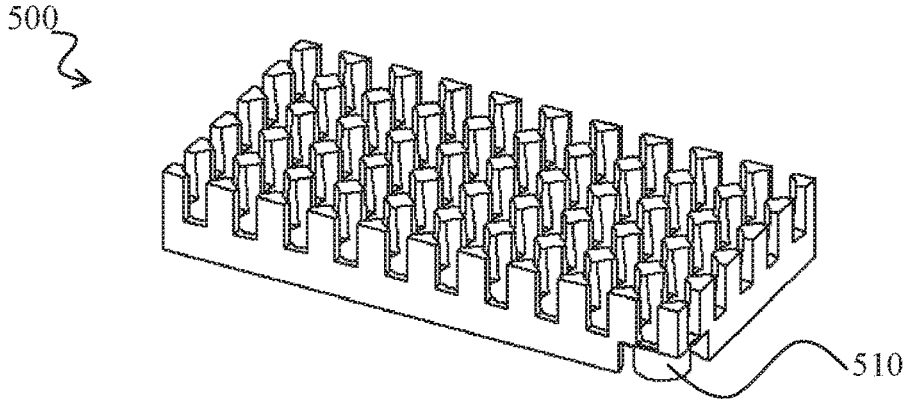
FIGS. 17-17*c* show an exemplary ammunition tray that includes a loading tool.
Figure 17B:
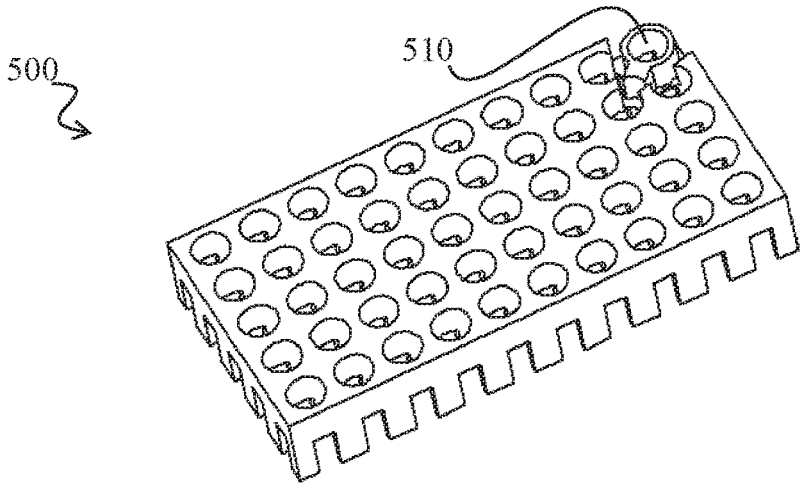
Figure 17C:
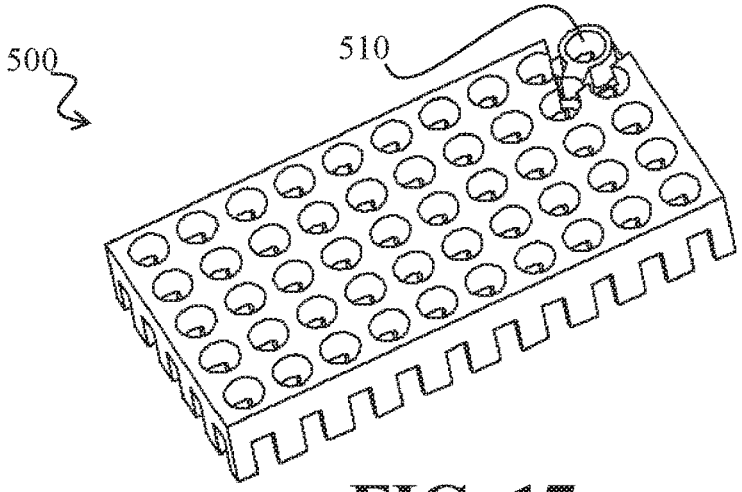
Figure 18A:
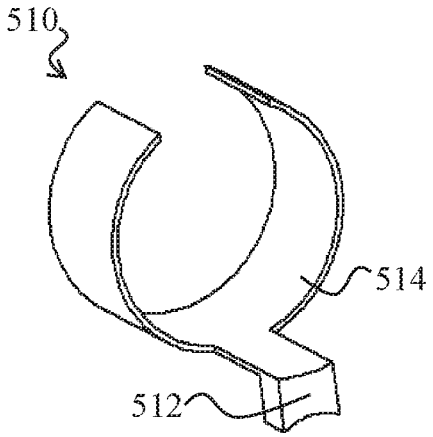
FIGS. 18*a*-18*e* show a raised angle perspective, level side perspective, top perspective, level side perspective, and bottom perspective of an exemplary loading tool.
Figure 18B:
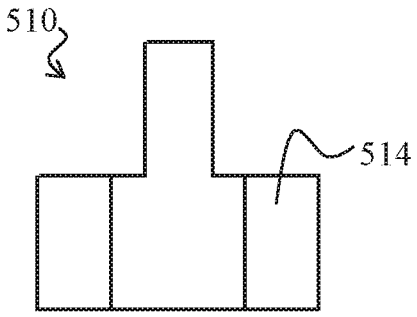
Figure 18C:
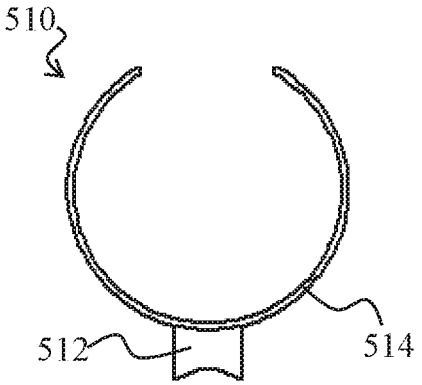
Figure 18D:
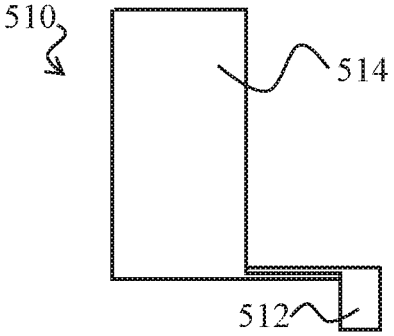
Figure 18E:
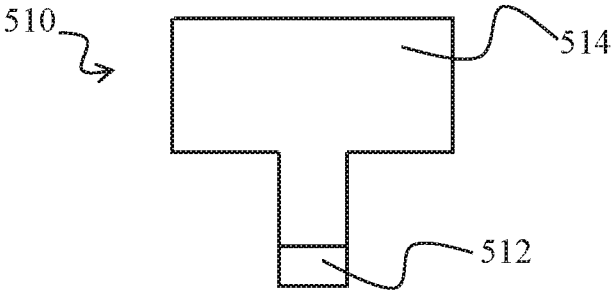

FIGS. 17*a*-17*c* show an exemplary embodiment in which an ammunition tray 500 may include a built-in removeable, and possibly disposable, loading tool 510. As shown in FIGS. 17*a*-17*c*, loading tool 510 may be manufactured as a part of, or otherwise secured to, ammunition tray 500.

Figure 19:
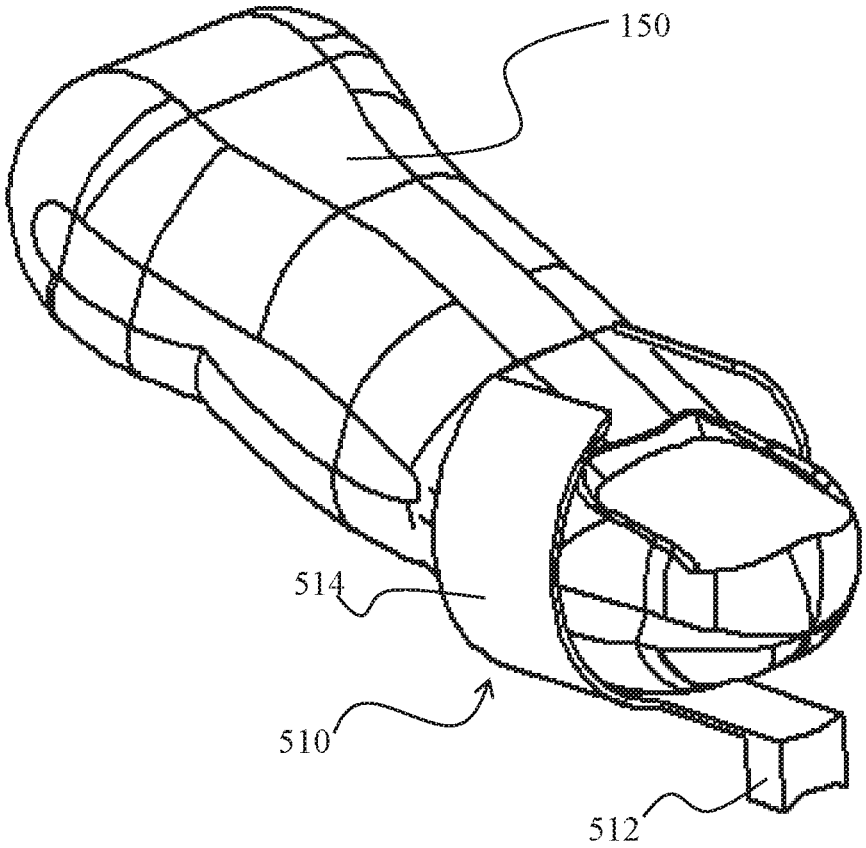
FIG. 19 shows a thumb engaged with an exemplary loading tool.
Figure 20:
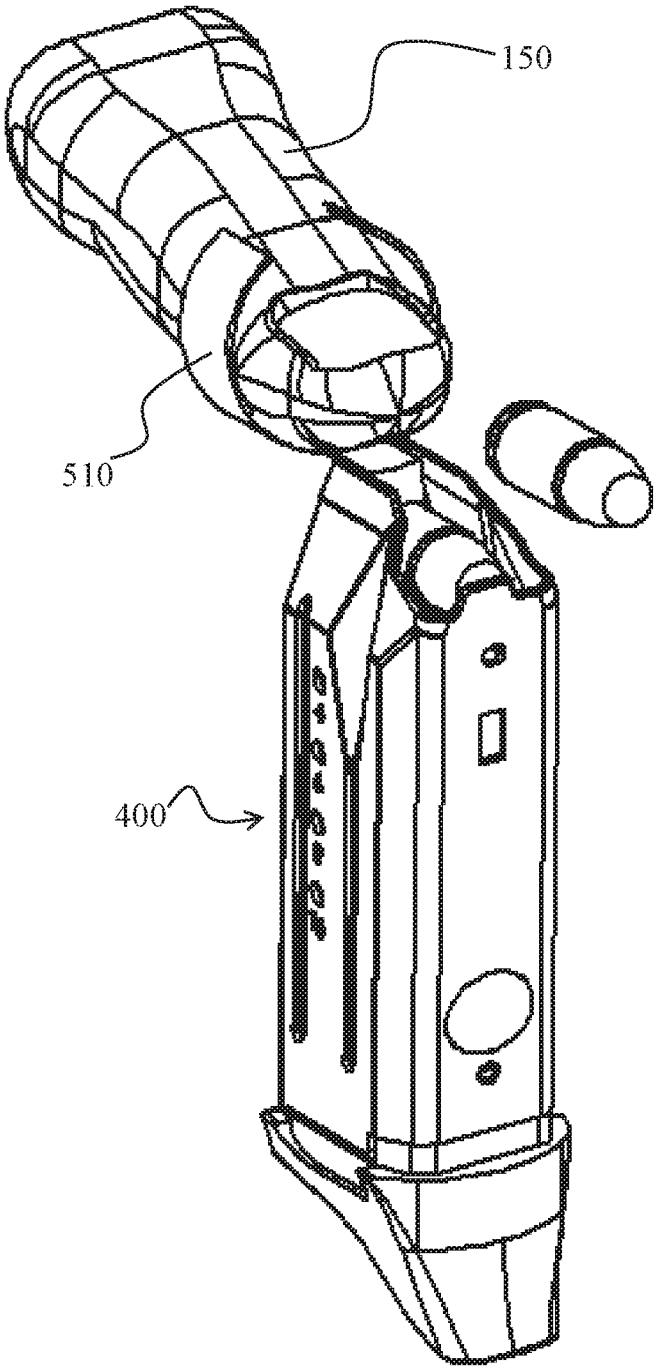
FIG. 20 shows a thumb, engaged with an exemplary loading tool, loading a cartridge into a magazine.

FIGS. 18*a*-18*e* show five different perspectives of a loading tool 510. In general, loading tool 510 comprises a finger adapter 514 and a saddle 512. As shown in FIGS. 19 and 20, a user may insert his or her thumb 150 (or other finger) into finger adapter 514, and may then use saddle 512 to engage a cartridge as described herein above relative to method 300, and as shown in FIG. 13. Using tool 510 may make it easier to use the ammunition tray disclosed herein to engage a cartridge and load the cartridge into a magazine.

The system and method disclosed herein may be applied to any system that involves loading cartridges or similar units into a magazine or similar repository. The disclosure herein is not limited to handguns.

What is claimed is:

1. An ammunition tray, comprising at least two ammunition apparatuses, wherein:

each ammunition apparatus comprises:

a bay that is substantially cylindrically shaped and configured to receive only a single ammunition cartridge;

an access channel configured to allow manipulation of an ammunition cartridge disposed in the bay;

a slide restraint configured to restrain an ammunition cartridge from sliding out of the bay in at least one direction; and a saddle disposed on the outside of the bay, opposite the access channel, and shaped to track a contour of a cartridge, wherein the saddle is configured to engage an ammunition cartridge loaded in a magazine, so as to depress said loaded ammunition cartridge, to allow an ammunition cartridge in said bay to be loaded directly into said magazine; and the at least two ammunition apparatuses are secured to each other along the length of the ammunition apparatuses such that the access channels of the at least two ammunition apparatuses are oriented in the same direction.

2. The ammunition tray of claim 1, wherein each access channel comprises an approximately 60-degree cross-sectional cutout from the associated bay.

3. The ammunition tray of claim 1, wherein the slide restraint of each ammunition apparatus comprises at least one fin, disposed on the interior of the bay, and shaped to track the contours of a tapered bullet end of a cartridge.

* * * * *